US005430976A

United States Patent [19]

Wirsing

[11] Patent Number: 5,430,976

[45] Date of Patent: Jul. 11, 1995

[54] HOLDING DEVICE

[75] Inventor: Timothy A. Wirsing, Saginaw, Mich.

[73] Assignee: General Motors Corporation, Detroit, Mich.

[21] Appl. No.: 203,064

[22] Filed: Feb. 28, 1994

[51] Int. Cl.[6] ..... E05D 13/00

[52] U.S. Cl. ..... 49/452

[58] Field of Search ..... 49/502, 372, 374, 376, 49/452

[56] References Cited

U.S. PATENT DOCUMENTS

| | | | |
|---|---|---|---|
| 3,591,983 | 7/1971 | Hanson | 49/452 X |
| 4,747,232 | 5/1988 | Stephenson et al. | 49/452 |
| 4,910,917 | 3/1990 | Brauer | 49/452 X |
| 4,956,942 | 9/1990 | Cisak et al. | 49/502 |
| 5,086,586 | 2/1992 | Hlavaty et al. | 49/376 X |

*Primary Examiner*—Jerry Redman
*Attorney, Agent, or Firm*—Ernest E. Helms

[57] ABSTRACT

A holding device for attaching, in a preferred embodiment, a window regulator channel blade to a vehicle door, the blade being subject to adjustment along three axes before final attachment to the door, the holding device including a nut having a fixed axis with respect to the door; a slider slidably engaged with the nut being adjustable with the nut along a first axis, the slider having an ear and an elbow spaced therefrom; a polymeric insert providing a nest for compliantly holding the blade, allowing adjustment of the blade with respect to the slider along two axes of adjustment and the insert having a guide surface for urging the blade into the nest; and a bolt for threadably penetrating the nut wherein torquing of the nut causes the nut and the slider to be affixed with respect to the door.

8 Claims, 2 Drawing Sheets

HOLDING DEVICE

FIELD OF THE INVENTION

The field of the present invention is that of holding devices which facilitate adjustment of an item to be held.

BACKGROUND OF THE INVENTION

There are two major types of vehicle door window arrangements. The first arrangement is that of a sedan-type vehicle door. In the sedan-type vehicle door, the door has a channel that extends above the belt level of the door and encloses a glass window pane when the glass window pane is in its top position. A second type of vehicle door is the hard-top vehicle door wherein the glass, after extending from the belt line of the vehicle door, is totally unsupported above the belt line and mates with the weatherstrip along a door opening of the vehicle. In the hard-top design, the stability of the window glass is totally achieved by its connection with the door below the belt line of the vehicle door.

Many vehicle doors with extendable windows of the hard-top variety have two parallel channels mounted within the interior of the door. A cross arm (as in Lain et al, U.S. Pat. No. 4,924,627), a cable (as in Dupuy, U.S. Pat. No. 5,067,281) or a tape drive (as in Staran et al, U.S. Pat. No. 4,642,941) regulator mechanism is thereafter attached with the vehicle door. Thereafter, the glass window is attached to the channel members via guide blocks to complete the assembly. The various components are then adjusted to assure the proper fit of the window and to prevent any possible binding in the up and down movement of the window.

To reduce costs, and in an attempt to prevent alignment problems, it is desirable to allow the channel members and regulator assembly to be assembled to the vehicle door as one pre-assembled module.

Typically, the channel members will be bridged by a narrow top cross beam and a wide cross beam which supports the window regulator and optional motor. The channel members and the cross beams form a module. The narrow beam is typically attached to the top end of the door. The window glass is then typically attached to the module. A more detailed description of the method of glass attachment to the module may be gained by a review of Wirsing, U.S. Pat. No. 5,363,595, commonly assigned.

The top beam is joined to the door directly adjacent to the top end of the door, and the glass in an extended position is mated with the weather stripping that surrounds a top edge of the vehicle door opening. To ensure the proper fit of the glass with respect to the door opening, adjustment must be made in the location of the bottom ends of the channel in an inner and outer direction. One channel lower end is first attached to the vehicle to adjust the glass regulator module for proper fit of the window with respect to the door opening. The other channel lower end (typically the front channel in the door) is left unattached. The window is then lowered. The free end allows the module to seek its own location before final attachment. The above process allows the glass/regulator module to seek the best non-binding position for when the glass must again be raised.

The lower end of the front channel must be free to move along three axes until it reaches its final position. A holder is then needed to hold the front channel lower end in its final position which can accommodate its adjustment along three separate axes. It is important to note that this holder must attach with the channel lower end before the adjustments for window glass/weatherstrip mating and window regulator binding prevention are made.

SUMMARY OF THE INVENTION

The present invention is a preferred embodiment providing a holder which allows for the attachment of a first object to a second fixed object, the first object being subject to adjustment along three axes.

DESCRIPTION OF THE PREFERRED EMBODIMENT

Figure 1:
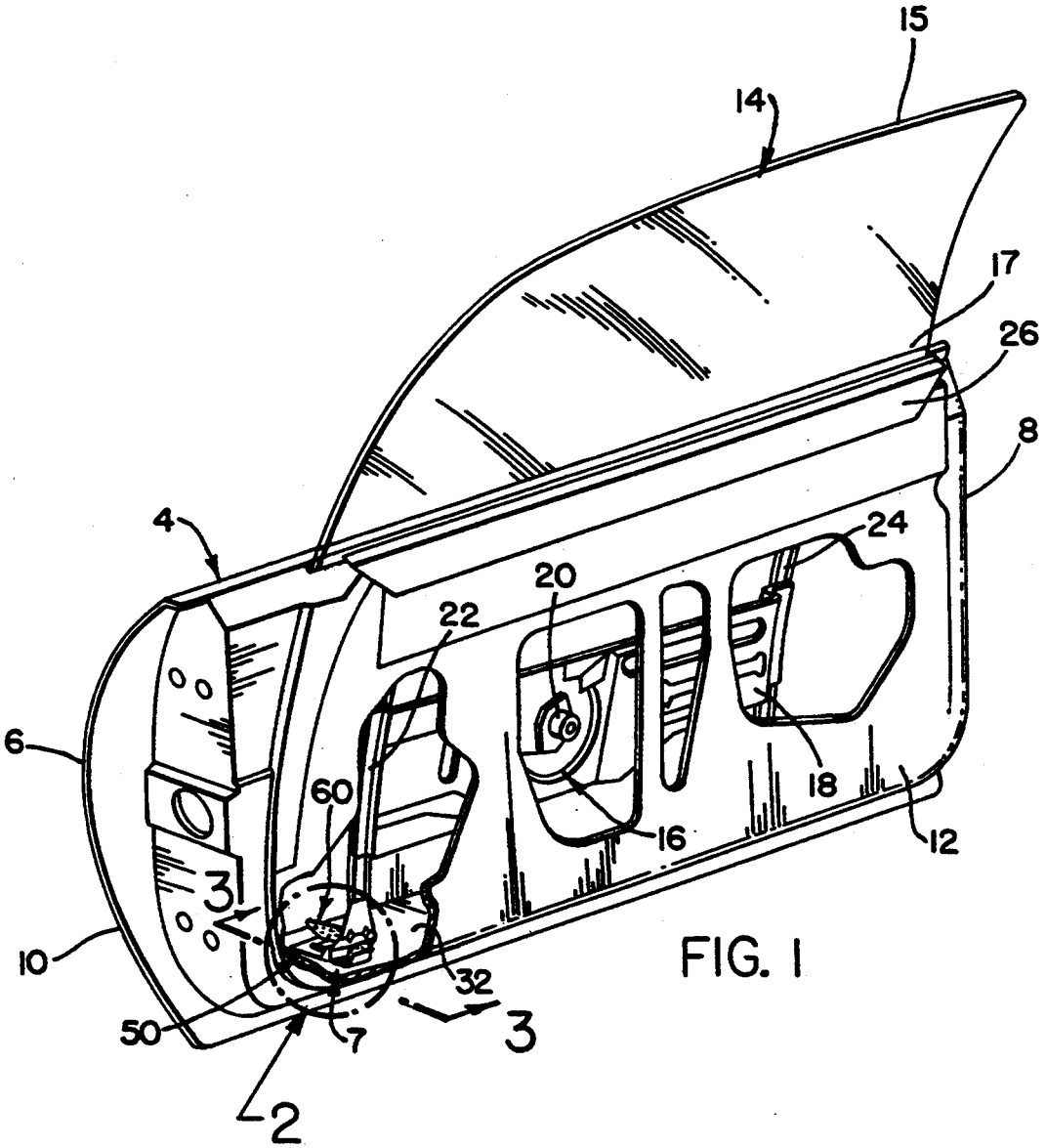
FIG. 1 is a perspective view illustrating utilization of the present invention in a preferred embodiment in its typical environment.
Figure 2:
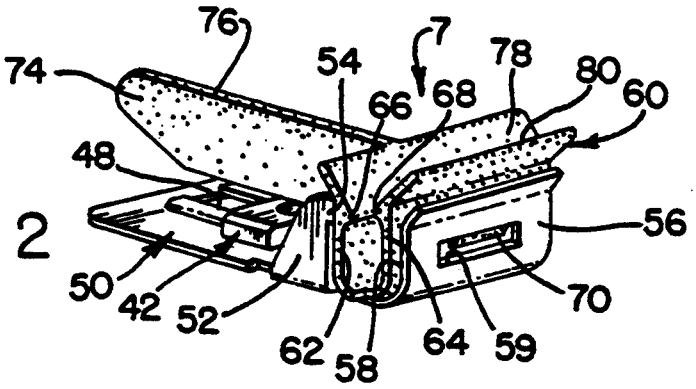
FIG. 2 is an enlarged view of the present invention shown in FIG. 1.

Referring to FIG. 1, the holder 7 of the present invention is shown in its installed position of the hard-top vehicle door 4. Door 4 has a front end 6 and a rear end 8. The door also has an outer panel 10 which is spaced away from an inner panel 12. Installed within the door is a window glass 14 which is regulated upwardly and downwardly by a regulator module 16. The window glass 14 has an inward curvature, placing a top edge 15 of the glass at a more inner position than the lower edge 17 of the glass.

The regulator module 16 has a wide cross beam 18 which supports a window lift mechanism which includes a regulator motor 20. The regulator motor 20, via a tape drive or cross-arm mechanism (not shown), supports window glass 14. The cross beam 18 is fixably connected to a forward channel 22 and a rearward channel 24. The top ends of the channels 22 and 24 will typically be attached to a top cross beam 26. The lower end of the channel 22 is fixably or integrally connected with a plane or blade 28, which is held by the holder 7.

Figure 3:
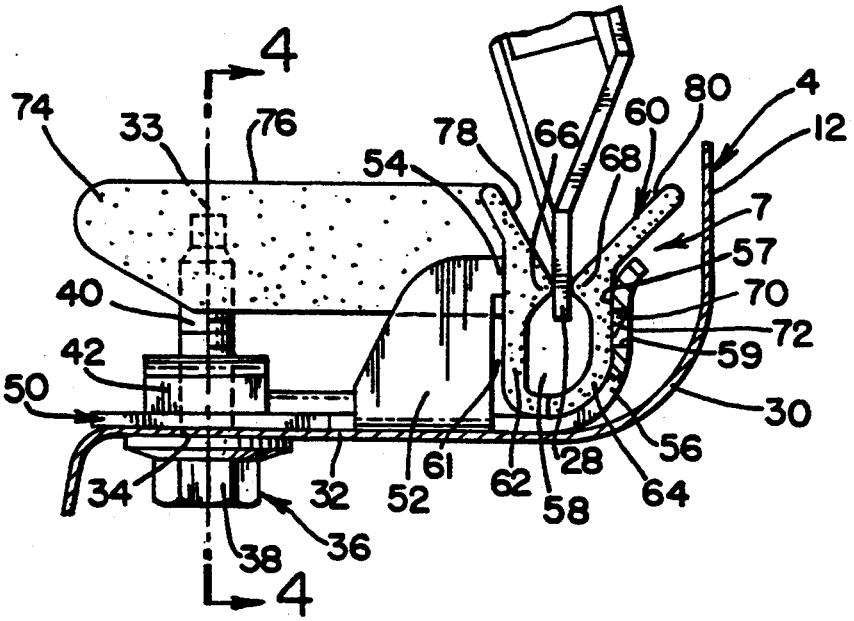
FIG. 3 is a view taken along line 3—3 of FIG. 1.
Figure 4:
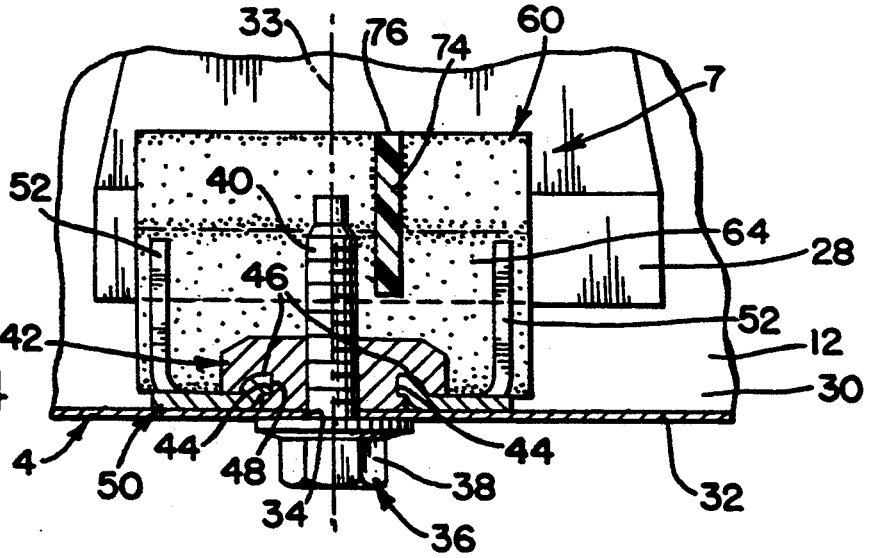
FIG. 4 is a view taken along line 4—4 of FIG. 3.

The inner panel 12 (as best shown in FIGS. 3 and 4) has a curvature 30 whereupon it forms a door floor 32. The door floor 32 is penetrated by an aperture 34 and has inserted therethrough a bolt 36 having a head 38 and a threaded shank 40. Threaded upon the shank 40 is a nut 42. The nut 42 has two longitudinal grooves 44 which are interlocked within the sides 46 of a slot 48 provided in a slider plate 50. The interlocking of the nut 42 with the slot 48 of the slider retains the nut 42 with the slider plate. When the bolt 36 is not torqued to a tight position with respect to the nut 42, the slider plate 50 can slide with respect to the nut 42.

The slider plate 50 has two upper extending ears 52 having protruding surfaces 54. Slider plate 50 also has an elbow 56 having a rectangular elongated window 59. Between the ear 52 and the elbow 56, there is spaced a nest 58. Inserted within the nest is an insert 60. Insert 60 has an inner wall 62 and an outer wall 64. The walls 62 and 64 have respective pinchers 66 and 68. Additionally, the outer wall 64 has a triangular cross-sectional extension 70. The extension 70 has an inclined wall 72.

Insert 60 pops into the slider plate 50 by the wall 72 sliding against the surface 57 of the elbow 56 until the extension 70 pops into the rectangular window 59. The protruding surfaces 54 ensure a controlled clearance 61 between the wall 62 and the ear 52 to ensure maximum loading of the pinchers 66, 68 on the blade 28 and not at another location within the nest 58.

The slider plate 50 will typically be made from a steel material. However, the insert 60 will typically be a polymeric material such as acetal. Joined to the inner wall 62 is an alignment blade 74 having a top guide surface 76.

In operation, the bolt 36 will be inserted into the fixed location bore 34 of the floor plate 32. The bolt 36 will be turned into the nut 42; however, it will not be completely tightened, thereby allowing the holder 7 to have pivotal motion with respect to the floor 32 along a fixed pivotal axis 33. A vehicle installer (not shown) will first place the module 16 through a top opening provided in the door 4. The top cross beam 26 is connected to the door 4, and the window glass 14 will then be connected with the module 16. When inserting the module into the door 4 between the inner and outer panel, the blade 28 if in an incorrect position will hit the top edge 76 of the insert blade 74, preventing improper installation of the module 16 and alerting the operator of such improper installation. Manipulation of the module 16, if required, will bring the channel blade 28 into a position where it hits one of the inclined surfaces 78 or 80 provided on the insert walls. It will then go down until it is engaged by the pinchers 66 and 68. Subsequently, the window glass 14 will be extended to an extreme upper position. The top edge 15 of the window glass will be aligned with the door opening. Inner and outer adjustment (of the glass 14) will be accomplished by setting the position of the bottom edge of the channel 24 in an inner and outer position by a mechanism (not shown).

The glass 14 is then lowered to its extreme lower position, causing the blade 28 to possibly move along an axis parallel to the inner and outer direction of the door 4. The blade also can move along an axis in a forward or rearward direction of the door 4 or along an axis vertically up and down. Additionally, since the slider plate 50 can pivot, the holder can accommodate a blade 28 which is not oriented in a direction parallel to the fore and aft direction of the vehicle door 4.

As the window 14 is regulated downward, blade 28 will seek its most desirable final position. At that point, the assembler will then tighten the bolt 36, and the compliant force of the pinchers 66 and 68 will hold the blade in this set position. It will be evident to those knowledgeable in the art that the holder 7 in its final adjusted position will accommodate variances in door and regulator module construction and will ensure proper positioning of the blade 28 for maximum prevention of binding on the upward travel of the window subsequent to its final assembly within the door 4.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A holding device for attaching a first plane object to a second object, the first object being subject to adjustment along three axes before final attachment to the second object, the holding device comprising:

a first member having a fixed axis with respect to the second object and being fixed with the second object after adjustment of the first object; and a second member slidable along a fixed axis with respect to the first member, the second member also having a nest with an open slot for compliantly holding the first object, allowing adjustment of the first object with respect to the second member along two axes of adjustment, the second member being fixably connected with the first member after adjustment of the first object.

2. A holding device as described in claim 1 wherein the first member is a nut and a threaded fastener connects the nut with the second object and the thread fastener also connects the nut to the second member.

3. A holding device as described in claim 2 wherein the nut is captured in a slot in the second member.

4. A holding device as described in claim 1 wherein the second member is comprised of two parts a first part being operatively associated with the first member and a second part providing the nest that holds the first object.

5. A holding device as described in claim 1 further comprising a guide surface to urge the first object into the nest.

6. A holding device as described in claim 1 wherein the second member has pivotable adjustment with respect to the second object.

7. A holding device for attaching a first plane object to a second object, the first object being subject to adjustment along three axes before final attachment to the second object, the holding device comprising:

a nut having a fixed axis with respect to the second object;

a slider slidably engaged with the nut being adjustable with the nut along a first axis, the slider having an ear and an elbow spaced therefrom;

an insert providing a nest for compliantly holding the first plane object, allowing adjustment of the first object with respect to the slider along two axes of adjustment and the insert having a guide surface for urging the plane object into the nest; and a bolt for threadably penetrating the nut wherein torquing of the nut causes the nut and the slider to be affixed with respect to the second object.

8. A holding device as described in claim 7 wherein the second object is an automotive door and the first object is part of a window regulator module.

* * * * *